US007203986B2

(12) United States Patent
Pears et al.

(10) Patent No.: US 7,203,986 B2
(45) Date of Patent: Apr. 17, 2007

(54) MOTORIZED HAND HELD CLEANING TOOL WITH CLAMP ON EXTENSION HANDLE

(75) Inventors: Barry Pears, Langley Moor (GB); Cheung Wun Yau, Kowloon (HK)

(73) Assignee: Black & Decker Inc., Newark, DE (US)

( * ) Notice: Subject to any disclaimer, the term of this patent is extended or adjusted under 35 U.S.C. 154(b) by 598 days.

(21) Appl. No.: 10/607,866

(22) Filed: Jun. 27, 2003

(65) Prior Publication Data

US 2004/0261204 A1 Dec. 30, 2004

(51) Int. Cl.
*A46B 13/02* (2006.01)
*B25G 3/00* (2006.01)

(52) U.S. Cl. ..... 15/28; 15/49.1; 15/97.1; 15/98; 15/145; 16/422; 16/426; 16/427

(58) Field of Classification Search ..... 15/28, 15/29, 49.1, 97.1, 98, 145, 146, 246; 16/422, 16/426, 427
See application file for complete search history.

(56) References Cited

U.S. PATENT DOCUMENTS

| | | | | | |
|---|---|---|---|---|---|
| 237,891 | A * | 2/1881 | Musselman | ..... | 16/426 |
| 239,660 | A * | 4/1881 | Hurlburt | ..... | 15/145 |
| 467,046 | A * | 1/1892 | Myers | ..... | 15/146 |
| 1,083,054 | A * | 12/1913 | Brown | ..... | 294/58 |
| 1,534,075 | A * | 4/1925 | Parrish | ..... | 16/426 |
| 2,244,585 | A * | 6/1941 | Tweit | ..... | 16/426 |
| 3,608,481 | A | 9/1971 | Price et al. | | |
| 3,758,914 | A | 9/1973 | Nupp et al. | | |
| 4,217,671 | A * | 8/1980 | Rand | ..... | 15/24 |
| 4,766,638 | A | 8/1988 | McDowell | | |
| RE32,751 | E | 9/1988 | Joss et al. | | |
| 4,782,432 | A | 11/1988 | Coffman | | |
| RE33,074 | E | 10/1989 | Levine | | |
| 5,025,529 | A | 6/1991 | Hult et al. | | |
| 5,191,275 | A | 3/1993 | Singhal | | |
| 5,486,432 | A | 1/1996 | Sharrah et al. | | |
| 5,819,364 | A | 10/1998 | Sham | | |
| 6,360,402 | B1 * | 3/2002 | Crabtree | ..... | 16/430 |
| 6,434,774 | B1 * | 8/2002 | Castellon | ..... | 15/50.1 |

* cited by examiner

*Primary Examiner*—Mark Spisich
(74) *Attorney, Agent, or Firm*—Harness, Dickey & Pierce, P.L.C.

(57) ABSTRACT

A cleaning tool having a clamp-on handle assembly. The clamp-on handle assembly includes a slidable locking element which can be moved from an open position, wherein the handle assembly can be placed over a handle portion of the cleaning tool, to a locked position wherein the locking element clamps the handle assembly securely onto the handle portion of the cleaning tool. Advantageously, no external tools or fastening implements are required to secure the handle assembly to the handle portion of the cleaning tool. The handling assembly allows the user to use the cleaning tool to reach elevated areas or other areas that would be difficult to reach with the user holding directly onto the handle portion of the cleaning tool.

22 Claims, 4 Drawing Sheets

MOTORIZED HAND HELD CLEANING TOOL WITH CLAMP ON EXTENSION HANDLE

FIELD OF THE INVENTION

The present invention relates to cleaning tools, and more particularly to a hand-holdable cleaning tool having a removable clamp-on handle assembly for enabling a user to reach hard to access areas with the cleaning tool.

BACKGROUND OF THE INVENTION

Hand-holdable cleaning tools have proven to be very effective and useful cleaning implements for a wide variety of cleaning tasks. In particular, motorized cleaning tools, such as the ScumBuster®) hand holdable cleaning tool manufactured by the Assignee of the present application, have proven to be very popular and effective in a wide variety of cleaning applications, and especially in use in private homes such as in kitchens and bathroom areas of the home. Such motorized cleaning tools allow a user to more thoroughly scrub areas such as sinks, bathtubs, shower stalls, and a wide variety of other surfaces with the help of a motor driven brush or like cleaning implement.

With such hand held cleaning tools as described above, there is often a need to clean elevated areas or difficult to access areas which would be difficult, if not impossible, for the user to reach while holding the body (i.e., housing) of the cleaning tool itself. Accordingly, it would be desirable to provide some form of elongated handle that could be grasped by the user so that the tool could be used to clean elevated or difficult to access areas more easily by the user. Furthermore, it would highly desirable if such a handle could be quickly and easily removed from the cleaning tool when not needed. Such a removable handle would provide significant additional flexibility to the user when using the cleaning tool in different cleaning applications.

It would further be highly desirable if such a cleaning tool as described above could be provided that does not require any modification to the housing of the cleaning tool itself, before a removable, clamp-on handle is secured thereto, and further does not add appreciably to the overall weight of the cleaning tool, or to significantly increase the overall cost of the cleaning tool.

SUMMARY OF THE INVENTION

The present invention is directed to a hand held cleaning tool having a removable elongated handle assembly for enabling the tool to reach elevated or difficult to, access areas. In one preferred form the cleaning tool comprises an internally disposed motor which drives a brush or other like cleaning implement through a suitable gear reduction system. The removable handle, in one preferred form, comprises a main body portion which can be clamped on to a handle portion of a main housing of the cleaning tool. The main body portion includes structure for receiving an elongated handle member which can be easily grasped by the user once the main body portion is secured to the main housing of the cleaning tool. The user is then better able to use the cleaning tool to reach elevated and difficult to access areas. In a preferred form, the elongated handle has a length sufficient to allow it to be comfortably grasped with two hands, thus allowing the user to easily maneuver the cleaning tool.

In a preferred form, the main body portion includes a slidably disposed locking element. The locking element is disposed over a pair of flanges formed on opposite sides of a housing of the main body portion. The locking element can be slid from an unlocked position, wherein the main body portion can be easily slipped over a handle portion of the cleaning tool, and a locked portion wherein the flanges are drawn towards each other such that the main body portion is clamped over the handle portion of the cleaning tool. Thus, the main body portion can be quickly and easily mounted on the handle of the, cleaning tool or removed from the cleaning tool with a single sliding motion of the locking element. Cooperating structure between the housing of the main body portion and the locking element serves to help maintain the locking element in the locked position once it is moved into this position by the user, as well as prevent the locking element from being removed entirely from the main body portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
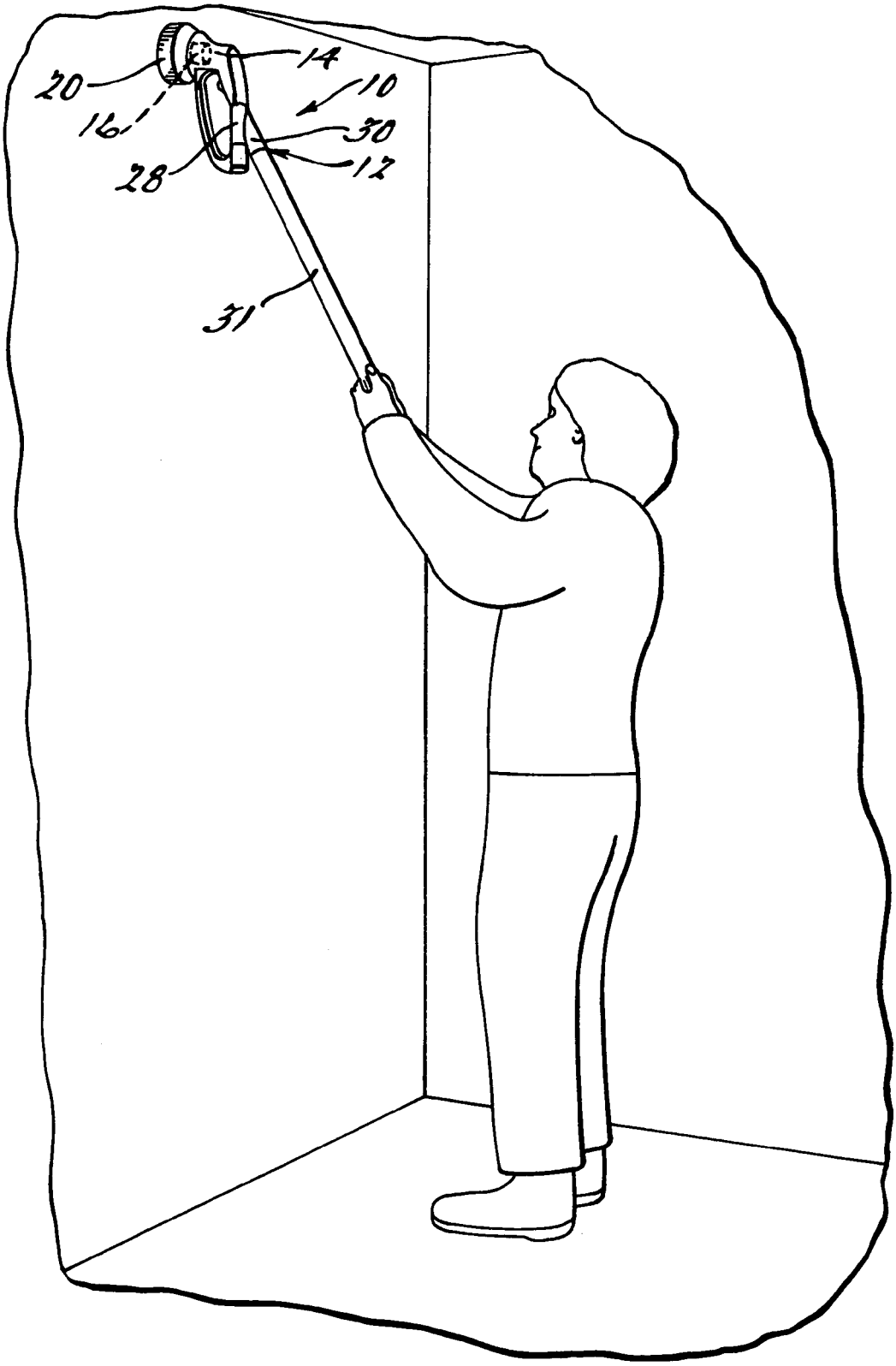
FIG. 1 is a perspective view of a hand holdable cleaning tool incorporating a removable elongated handle assembly in accordance with a preferred embodiment of the present invention, with the handle assembly being clamped to a handle portion of the cleaning tool.
Figure 2:
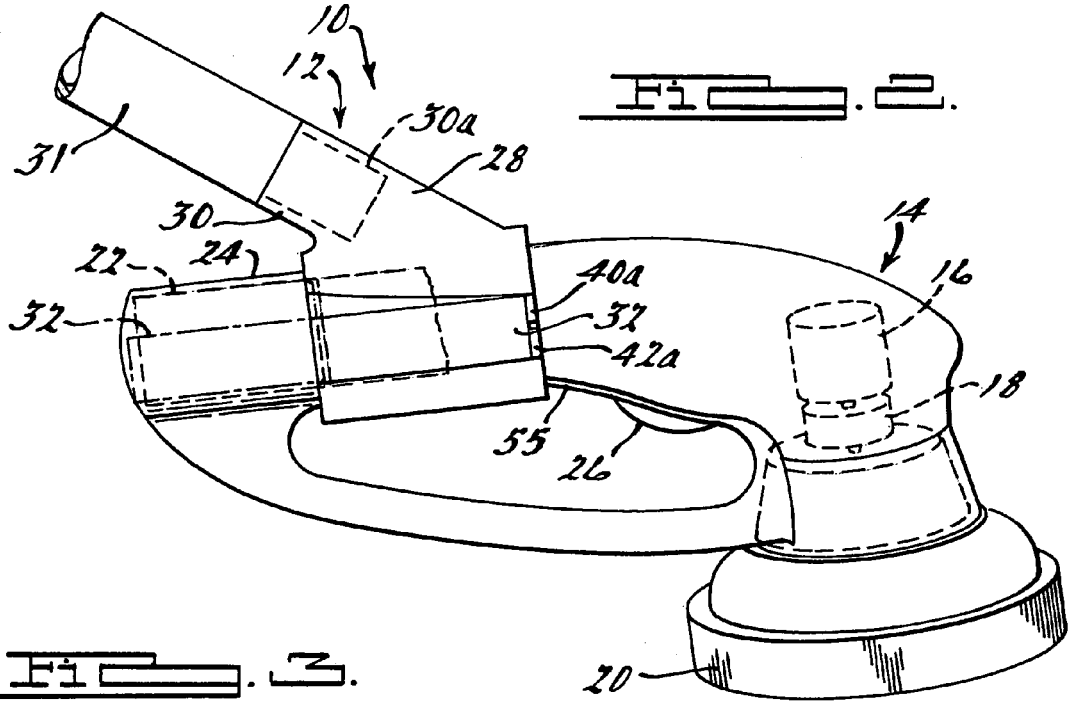
FIG. 2 is a side view of the apparatus of FIG. 1 but with the clamp-on handle assembly in the open position being ready to be removed from the cleaning tool.
Figure 3:
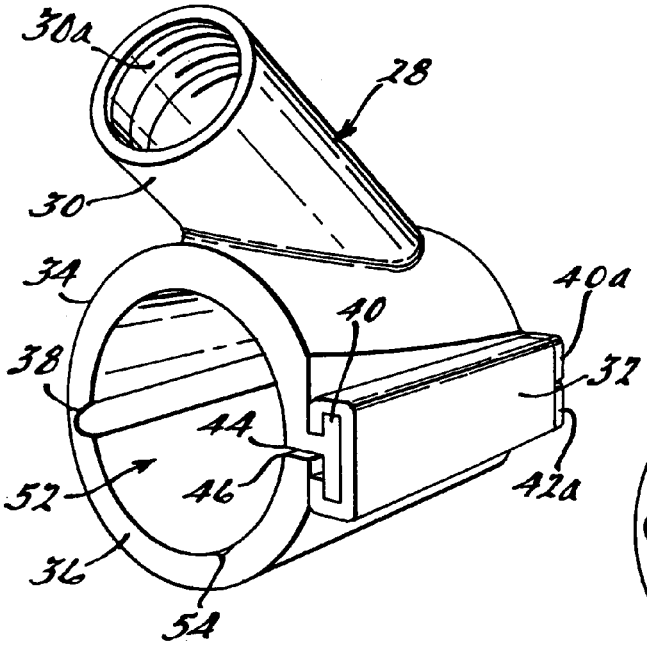
FIG. 3 is a perspective view of a main body portion of the handle assembly of FIG. 1.

Referring to FIGS. 1 and 2, there is shown a cleaning tool 10 in accordance with a preferred embodiment of the present invention. Cleaning tool 10 includes a clamp-on handle assembly 12. The cleaning tool 10 can be used to access elevated or difficult to reach areas. The cleaning tool incorporates a main housing 14 within which is disposed an electric motor 16. The electric motor 16 is coupled to a gear reduction unit 18 which rotationally drives a scrub brush or other like cleaning implement 20. The electric motor 16 is powered by a rechargeable battery pack 22 held within a handle portion 24 of the housing 14. An on/off switch 26 is used to apply electric power to the motor 16 to thus turn on and off the cleaning tool 10.

With specific reference to FIG. 2, the clamp-on handle assembly 12 includes a main body portion 28 having a neck 30 to which an elongated handle member 31 can be coupled. The handle member 31 can be secured to the neck 30 via adhesives or mechanical means such as by providing the handle member with a threaded end and an internal bore 30*a* of the neck 30 with threads for threaded engagement with the threaded portion of the handle member. Alternatively, it may be secured by a press fit or by a bayonet fitting.

The main body portion 28 of the clamp on handle assembly 12 further includes a slidably disposed locking element 32. The locking element 32 is shown in its "locked" position in FIG. 2, in its "unlocked" position in phantom in FIG. 2, and in perspective in FIG. 8. In the locked position, the handle assembly 12 is securely clamped over the handle portion 24 of the main housing 14 of the cleaning tool 10. When in the unlocked position, the handle assembly 12 can be lifted from the handle portion 24, as will be described further in the following paragraphs.

FIGS. 3–6 further illustrate just the main body portion 28 of the handle assembly 12. The main body portion 28 can be seen to include a first portion 34 and a second portion 36 coupled by a living hinge 38. First portion 34 further includes a flange 40 while second portion 36 similarly includes a flange 42. The flanges 40 and 42 are disposed along free edges 44 and 46 of the portions 34 and 36, respectively.

Figure 5:
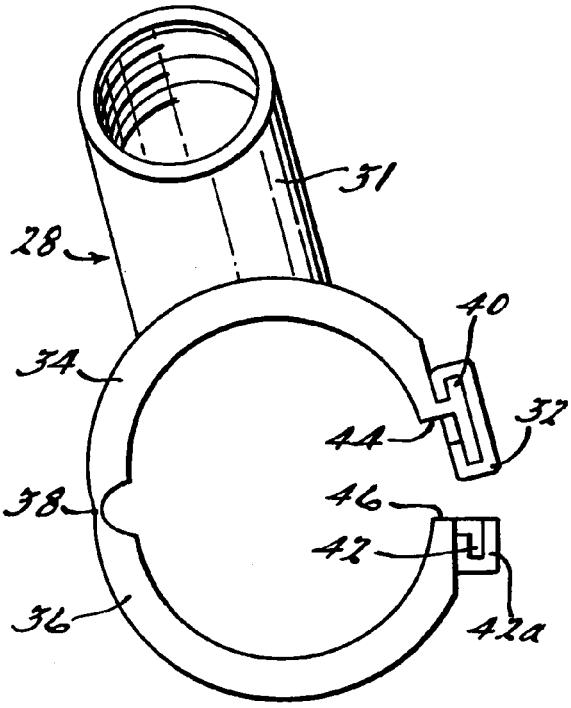
FIG. 5 is an end view of the handle assembly of FIG. 4 but with the main body portion thereof in the open position.
Figure 6:
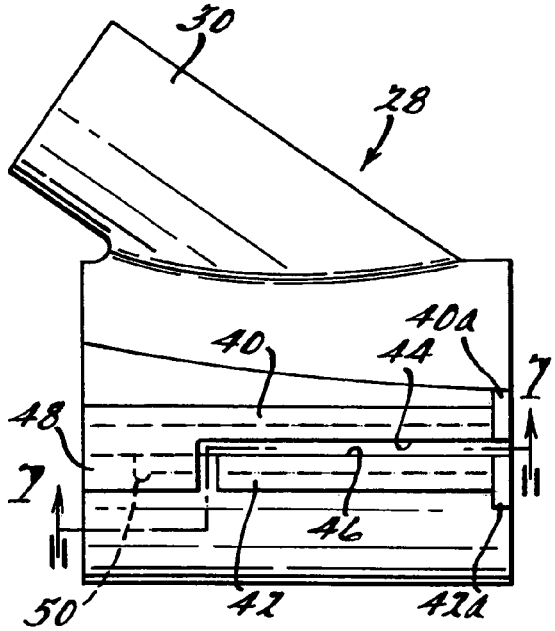
FIG. 6 is a side view of just the main body portion of the handle assembly of FIG. 4 (i.e., with a locking element thereof removed for clarity)

With brief reference specifically to FIG. 6, portion 34 further can be seen to include an extending portion 48 having a small projection 50. The main body portion 28 is integrally formed with the neck portion 30 preferably as a single molded component part from the suitably, strong material such as high strength plastic. The living hinge 38 allows portions 34 and 36 to be easily moved between the closed and open positions shown in FIGS. 4 and 5, respectively.

Figure 4:
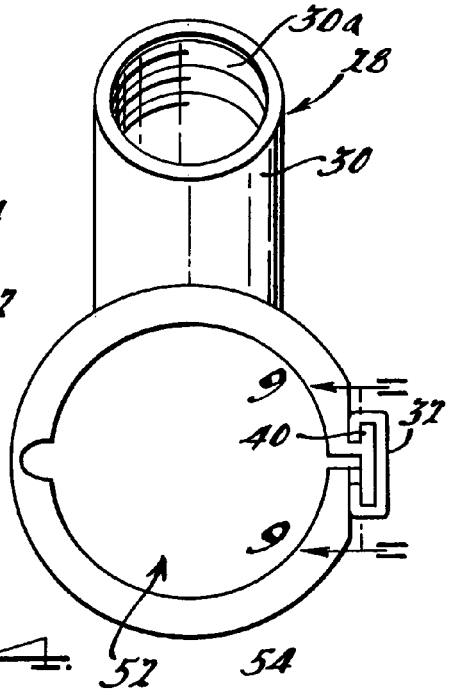
FIG. 4 is an end view of the main body portion of the handle assembly of FIG. 3 with the handle assembly in the locked position.

With specific reference to FIGS. 4 and 5, the main housing portion 28 further forms a bore 52 having a longitudinally extending groove or channel 54. Channel 54 is adapted to receive a longitudinally extending rib 55 (FIGS. 1 and 2) that helps to maintain the main body portion 28 in a desired orientation when secured to the handle portion 24 of the cleaning tool 10. As will also be appreciated, the bore 52 is sized such that it is able to fit over the handle portion 24 without play when the main body portion 28 is clamped to the handle portion 24.

Figure 7:
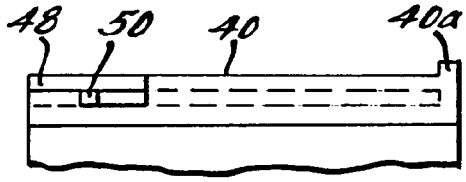
FIG. 7 is a side view of the main body portion of the handle assembly in the slightly open position illustrating structure associated therewith for retaining the locking element in its open and closed positions.

With further reference to FIG. 7, the projection 50 can be seen in even greater detail. The projection 50 is formed to reside slightly below flange 42. The projection 50 assists in holding the locking element 32 both in its locked position and in its unlocked position, as will be described momentarily.

Figure 8:
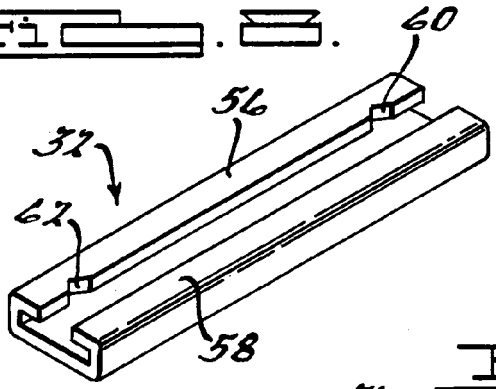
FIG. 8 is a perspective view of the locking element of the handle assembly shown in FIGS. 1 and 2.

Referring to FIG. 8, the locking element 32 can be seen in greater detail. The locking element 32 includes a pair of inwardly turned ledges 56 and 58. Ledge 56 has a first notch 60 and a second notch 62. First notch 60 assists in maintaining the locking element 32 secured to the main body portion 28 of the handle assembly 12 when the locking element 32 is in its unlocked position (FIG. 5). Notch 62, conversely, holds the locking element 32 in its locked position as shown in FIG. 1.

Figure 9:
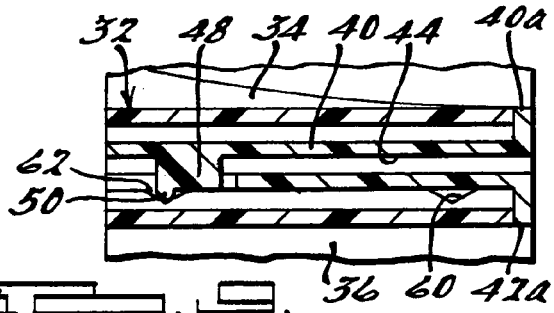
FIG. 9 is a partial cross-sectional view of the locking element in its locked position, taken in accordance with section line 9—9 in FIG. 4.
Figure 10:
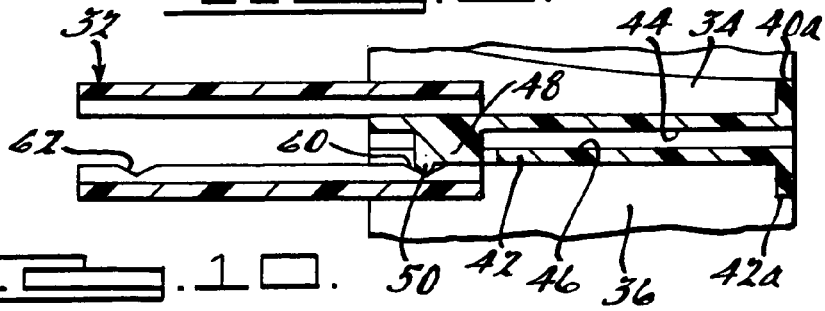
FIG. 10 is a cross-sectional view of the locking element of FIG. 9 but with the locking element moved to its unlocked position.

With reference to FIGS. 9 and 10, the locking element 32 can be seen in its locked orientation (FIG. 9) and in its unlocked orientation (FIG. 10). In its locked orientation, notch 62 receives the projection 50. In the unlocked position of FIG. 10, notch 60 receives the projection 50. To place the clamp assembly 12 onto the handle portion 24 of the tool 10, the user opens the locking element 32 into the position shown in phantom in FIG. 2, opens the second portion 36 of the main housing 28 as shown in FIG. 5, and places the main housing 28 over the handle portion 24 so that the main housing 28 is aligned with a longitudinal axis of the handle portion 24. The user then moves portions 34 and 36 towards each other until flanges 40 and 42 are closely adjacent one another or almost in abutting relationship, as shown in FIG. 4. The user then slides the locking element 32 forwardly over the flanges 40 and 42 into the position shown in FIGS. 1 and 3. Stops 40*a* and 42*a*shown in FIGS. 1, 3, 6, 9 and 10 stop forward movement of the locking element 32 just as the second notch 62 engages with the projection 50. In this position the handle assembly 12 is securely clamped to the handle portion 24 of the tool and the cleaning tool 10 can be manipulated easily by the user using one or both hands to grasp the elongated handle member 31 and maneuver the cleaning tool 10.

To remove the handle assembly 12, the steps are essentially reversed. The user simply slides the locking element 32, rearwardly into the position shown in phantom in FIG. 2. The locking element 32 will initially take a slight degree more force to begin its longitudinal travel as the projection 50 is urged out of notch 62. After this occurs, the locking element 32 can be moved more easily until the projection 50 is urged into engagement with notch 60, which again will take a slight degree of additional force to accomplish. Once projection 50 is engaged with notch 60, as shown in FIG. 10, the locking element cannot be moved any further longitudinally in the unlocking direction without significant additional force. Thus, the inter-engagement of the projection 50 and the notch 60 prevents the locking element 32 from being inadvertently removed from the main body portion 28. The extending portion 48 forms a surface which also helps to support the locking element 32 when it is in its unlocked position shown in FIG. 10.

The clamp-on handle assembly 12 thus forms a convenient and easy to use means for allowing an auxiliary extension handle to be secured to a handle portion of a cleaning tool. The handle assembly 12 of the present invention does not add appreciably to the overall weight of the combined handle assembly/cleaning tool combination, does not add appreciably to the overall cost of the combined assembly, and enables a user to reach elevated areas or other areas that would be difficult to access while holding on directly to the handle portion 24 of the cleaning tool 10 shown in FIGS. 1 and 2. In addition, the use of the handle assembly 12 does not necessitate the use of an auxiliary on/off switch for the tool 10 since the handle assembly does not interfere with access to the on/off switch 26 of the tool 10, and the on/off switch 26 is still conveniently accessible by the user.

Figure 11:
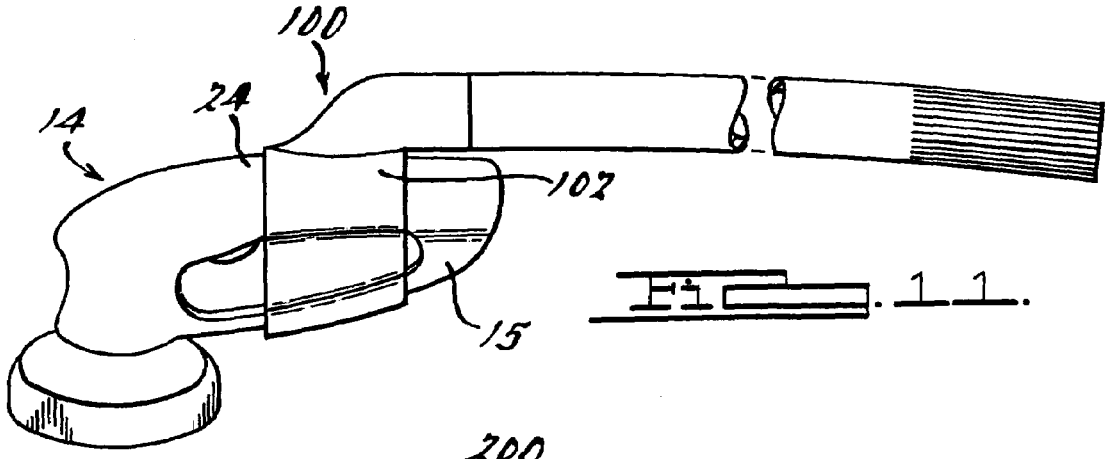
FIG. 11 is a perspective view of an alternative preferred embodiment of the clamp-on handle assembly of the present invention.

Referring now to FIG. 11, an alternative preferred embodiment 100 of the clamp-on handle assembly of the present invention is shown. This embodiment is similar to clamp-on handle assembly 12 but with the exception that a main body portion 102 of the assembly 100 is clamped around not only the upper handle portion 24 of the cleaning tool 14, but also a lower handle guard member 15 of the cleaning tool that defines the opening through which the fingers of a user's hand extend.

Figure 12:
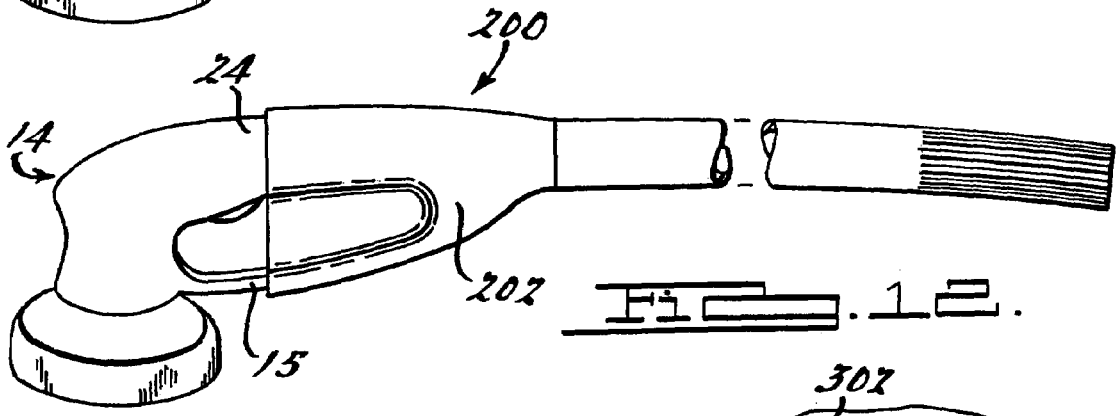
FIG. 12 is a perspective view of another alternative preferred embodiment of the clamp-on handle assembly of the present invention.

Referring to FIG. 12, yet another alternative preferred embodiment 200 of the clamp-on handle assembly is illustrated. This embodiment is similar to handle assembly 100 except that a main body portion 202 clamps over the entire upper handle portion 24 and lower handle guard member 15 of the cleaning tool 14.

Figure 13:
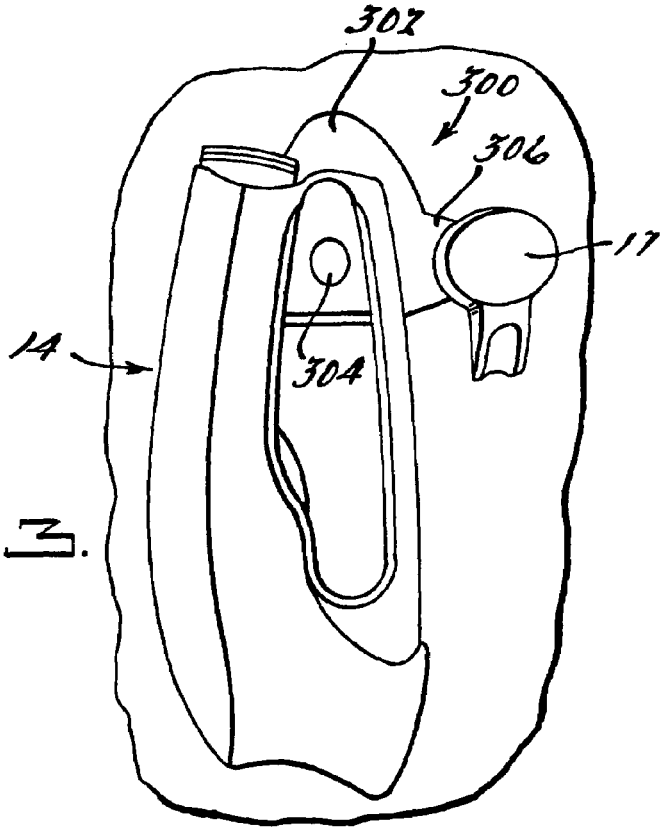
FIG. 13 is a perspective view of the cleaning tool of FIG. 1 hanging on a hanger.

Referring now to FIG. 13, the cleaning tool 14 can be seen hanging from a hanger 300. Hanger 300 is preferably formed from plastic and includes a base portion 302 having a hook 304 and a neck 306. Neck 306 can be used to support a removable end cap 17 of the cleaning tool 14. The base portion 302 can be secured to a wall or other like surface by any suitable fastening element, for example a threaded fastener, that extends through the hook 304 and the base portion 302.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A hand holdable tool comprising:

a tool housing having a portion graspable with a hand of a user for maneuvering the tool during use;

a clamp-on extension handle assembly adapted to be placed over at least a portion of the graspable portion of the tool, said clamp-on extension handle assembly including:

a main body portion having a first portion and a second portion hingedly moveable relative to the first portion;

a manually movable locking element operably associated with at least one of said first and second portions for holding said first and second portions clamped over said graspable portion when said locking element is placed in a locked position, and for enabling said main body portion to be removed from said graspable portion when said locking element is moved into an unlocked position;

said first and second portions of said main body each including a flange; and wherein said flanges cooperate with said locking element to enable said locking element to hold said first and second portions clamped over said graspable portion when said locking element is moved into said locked position.

2. The tool of claim 1, wherein said locking element comprises a slidably moveable locking element.

3. The tool of claim 1, wherein said first and second portions of said main body portion are coupled together by a living hinge.

4. The tool of claim 1, wherein said locking element is slidably disposed on one of said flanges.

5. The tool of claim 1, wherein said flanges are formed adjacent a split between terminal edges of said first and second portions.

6. The tool of claim 1, wherein at least one of said flanges includes a stop portion formed at one end thereof to limit movement of said locking element.

7. The tool of claim 1, wherein said clamp-on extension handle includes:

a neck portion projecting from said main body portion; and a handle member couple to said neck portion.

8. The tool of claim 1, wherein said main body portion includes a groove formed on one of said first and second portions; and wherein said graspable portion includes a rib formed thereon for engaging with said groove to maintain said main body portion secured against rotational movement relative to said graspable portion when said clamp-on handle assembly is clamped to said graspable portion.

9. A hand holdable tool comprising:

a tool housing having a portion graspable with a hand of a user for maneuvering the tool during use;

a clamp-on extension handle assembly adapted to be placed over at least a portion of the graspable portion of the tool, said clamp-on extension handle assembly including:

a main body portion having a first portion and a second portion hingedly moveable relative to the first portion; and a locking element having a channel and carried by one of the first and second portions, and moveable slidably between a locked position to engage with edges of said first and second portions to thus hold said edges in abutting engagement around said graspable portion of said tool and to clamp said main body portion to said graspable portion, and slidably movable to an unlocked position wherein said edges of said first and second portions are able to be separated sufficiently to remove said main body portion from said graspable portion.

10. The tool of claim 9, wherein said first and second portions each comprise a flange disposed adjacent said edge thereof; and wherein said locking element engages said flanges when moved into said locked position to hold said edges in abutting relationship.

11. The tool of claim 10, wherein at least one of said flanges includes a stop portion formed thereon for stopping sliding movement of said locking element when said locking element is moved into said locked position.

12. The tool of claim 10, wherein one of said flanges includes a projection; and wherein said locking element includes a ledge having a notch, said notch engaging said projection when said locking element is moved into said locked position to hold said locking element in said locked position.

13. The tool of claim 10, wherein one of said flanges includes a projection; and wherein said locking element includes a ledge having a notch, said notch engaging said projection when said locking element is moved into said unlocked position to hold said locking element in said unlocked position.

14. The tool of claim 10, wherein one of said flanges includes a projection; and wherein said locking element includes a portion having a pair of spaced apart notches, a first one of said notches engaging said projection when said locking element is moved into said locked position to thus hold said locking element in said locked position; and wherein said projection engages a second one of said notches when said locking element is moved into said unlocked position to thus hold said locking element in said unlocked position.

15. The tool of claim 10, further comprising a holder adapted to be fixedly secured to a wall for supporting said cleaning tool thereon when said cleaning tool is not in use.

16. A hand holdable cleaning tool comprising:

a cleaning tool main housing;

an auxiliary clamp-on handle assembly adapted to be releasably coupled to said cleaning tool main housing, said auxiliary clamp-on handle assembly including:

a main body portion having first and second portions hingedly coupled to one another so as to be positionable over said cleaning tool main housing; and a manually, slidably movable locking element having a channel coupled to one of said first and second portions for locking edge portions of said first and second portions in clamping engagement over said cleaning tool main housing.

17. The cleaning tool of claim 16, wherein said main body portion is formed from plastic and includes a living hinge coupling said first and second portions.

18. The cleaning tool of claim 16, wherein said edge portions of each of said first and second portions each include a flange; and wherein said locking element engages with said flanges to hold said main body portion of said auxiliary clamp-on handle assembly clamped to said cleaning tool main housing.

19. The cleaning tool of claim 16, wherein said main body portion includes a neck portion, and an elongated handle member insertable into said neck portion.

20. A method for forming a cleaning tool comprising:

securing first and second portions of a main body portion of an auxiliary handle hingedly relative to one another, and around a cleaning tool housing of said cleaning tool; and using a manually, slidable moveable locking element to engage edges of said first and second portions of said main body portion and to clamp said first and second portions around said cleaning tool housing; and using an elongated handle operably associated with said main body portion to effectively increase the reach of a user when using the cleaning tool.

21. The method of claim 20, further comprising coupling said first and second portions of said main body portion via a living hinge structure.

22. The method of claim 20, further comprising forming said edges of each of said first and second portions with a flange, and using said locking element to engage said flanges to clamp said first and second portions around said cleaning tool housing.

* * * * *